US005820019A

United States Patent [19]

Spitale

[11] Patent Number: 5,820,019

[45] Date of Patent: Oct. 13, 1998

[54] CLUSTER MAILBOX COMMUNICATION DEVICE

[75] Inventor: Peter M. Spitale, Palm Beach Gardens, Fla.

[73] Assignee: Innovative Creations, Incorporation, Palm Beach Gardens, Fla.

[21] Appl. No.: 572,515

[22] Filed: Dec. 14, 1995

[51] Int. Cl.[6] ..... B65D 91/00

[52] U.S. Cl. ..... 232/25; 232/24; 232/43.4

[58] Field of Search ..... 232/24, 25, 43.4, 232/34, 35

[56] References Cited

U.S. PATENT DOCUMENTS

| | | | |
|---|---|---|---|
| 2,563,094 | 8/1951 | Becker | 232/24 |
| 3,070,234 | 12/1962 | Deitchman | 232/24 |
| 4,121,758 | 10/1978 | Bonner | 232/24 X |
| 4,333,603 | 6/1982 | Carlson | 232/24 X |
| 4,875,621 | 10/1989 | Chivers | 232/34 |

*Primary Examiner*—Jerry Redman
*Attorney, Agent, or Firm*—Pennie & Edmonds LLP

[57] ABSTRACT

A cluster mailbox device that allows the box user to notify the mail carrier that the user's box contains outgoing mail or mail delivery instructions. The device has a fixed portion fastened to a box wall. A rotatable portion is pivotally attached to the fixed portion with a lever extending the length of the box so that the user may activate the device by applying a force to the lever, which raises the rotatable portion.

7 Claims, 7 Drawing Sheets

CLUSTER MAILBOX COMMUNICATION DEVICE

TECHNICAL FIELD OF THE INVENTION

The present invention relates to cluster mailboxes, and more particularly, to a device that allows the mailbox user to communicate to the mail carrier that the box contains outgoing mail or delivery instructions.

BACKGROUND OF THE INVENTION:

Single family homes typically have individual mailboxes located at the end of each driveway. The individual mailboxes each have a pivotable flag attached to the sidewall of the mailbox. When the resident has outgoing mail or a note for the carrier concerning mail delivery, the resident places the article in the mailbox and raises the mailbox flag so that the carrier is notified to retrieve the article within the mailbox.

Residents of developments, such as town homes or condominiums, typically do not have the luxury of having individual mailboxes at each home because of the population density. Therefore, mailboxes are grouped together in a matrix or cluster configuration. The cluster mailboxes help to improve the efficiency of the mail carrier since the carrier has the opportunity to deliver several households' mail at one stop.

Nevertheless, the disadvantage of cluster mailboxes is that they do not have a means for the box user to communicate to the mail carrier in the event the user has outgoing mail or general delivery instructions, such as a change of address, return of a signed receipt, a stop or start delivery notice, or the return of mis-addressed mail. The mail carrier's improved efficiency offered by the cluster box is negated to a certain extent because of this lack of a means to communicate between the box user and the mail carrier.

DISCLOSURE OF THE INVENTION

It is, therefore, an object of the present invention to provide a cluster mailbox device that allows the mailbox user to communicate to the mail carrier that there is outgoing mail or a delivery instructions in the user's mailbox.

It is also an object of the present invention to provide a cluster mailbox device that may be retrofitted to existing individual cluster mailboxes.

It is also an object of the present invention to provide a cluster mailbox device that may be used either with single front panel access cluster mailboxes or with dual front and rear panel access cluster mailboxes.

It is also an object of the present invention to provide a cluster mailbox device that is secured internally of the mailbox so that only the mailbox user and the mail carrier have access to the device.

According to the present invention, a cluster mailbox device is described that allows the box user to communicate to the mail carrier that the box contains outgoing mail or delivery instructions. For cluster mailboxes that have a single front access panel for the mail carrier and the box user, the device has a fixed portion and a rotatable portion. The portions are pivotly connected together with the fixed portion mounted to a mailbox internal wall. The user raises the rotatable portion into a box cavity to notify the mail carrier that the box contains mail or delivery instructions. The mail carrier lowers the flag to retrieve the box contents.

For cluster mailboxes that have rear panel access for the mail carrier and front panel access for the box user, a second embodiment of the device is disclosed. The device is similar to the above described device, except that the device further has a lever extending along the longitudinal length of the mailbox. The box has a passageway with a user end and a carrier end. The fixed and rotatable portions are located at the carrier end of the box passageway. A lever handle is located at the user end; the lever raises the rotatable portion to notify the carrier that the box contains out going mail or delivery instructions. The carrier then pushes on the rotatable portion to lower it and to retrieve the box contents.

The foregoing and other advantages of the present invention will become more apparent from the following description and accompanying drawings.

BEST MODE FOR CARRYING OUT THE INVENTION

Figure 1:
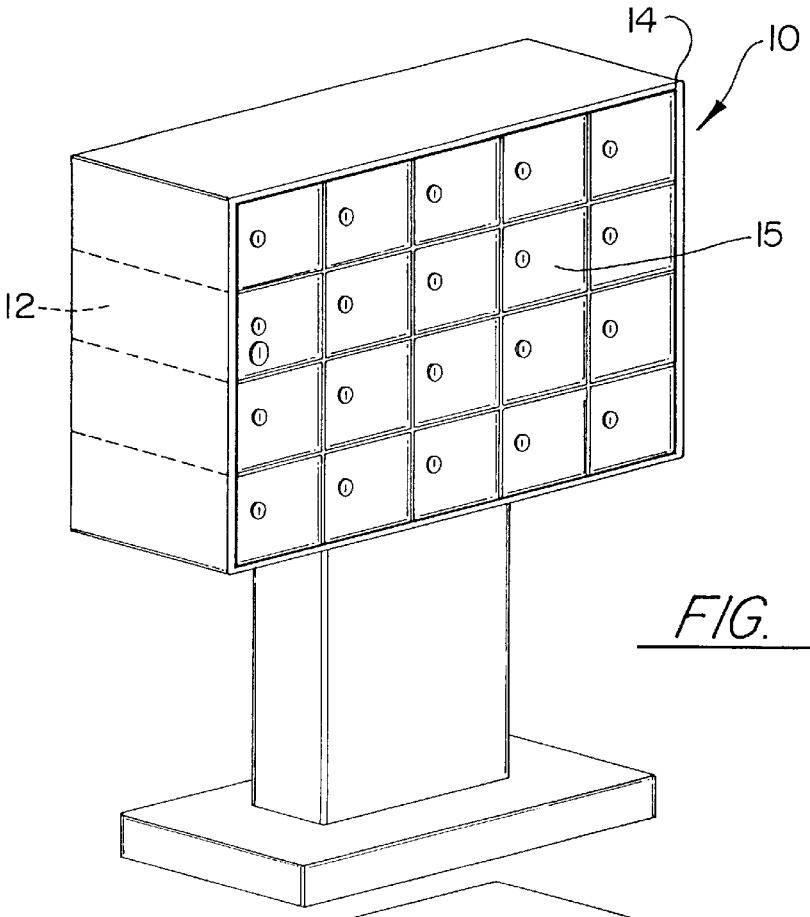
FIG. 1 is a front perspective view of a cluster mailbox with a front access panel.

As shown in FIG. 1, a cluster box 10 has a plurality of individual boxes 12 arranged in a matrix configuration. The cluster box 10 has a front multiple access panel 14 that comprises a plurality of individual mailbox doors 15 that correspond to the individual boxes 12.

Figure 2:
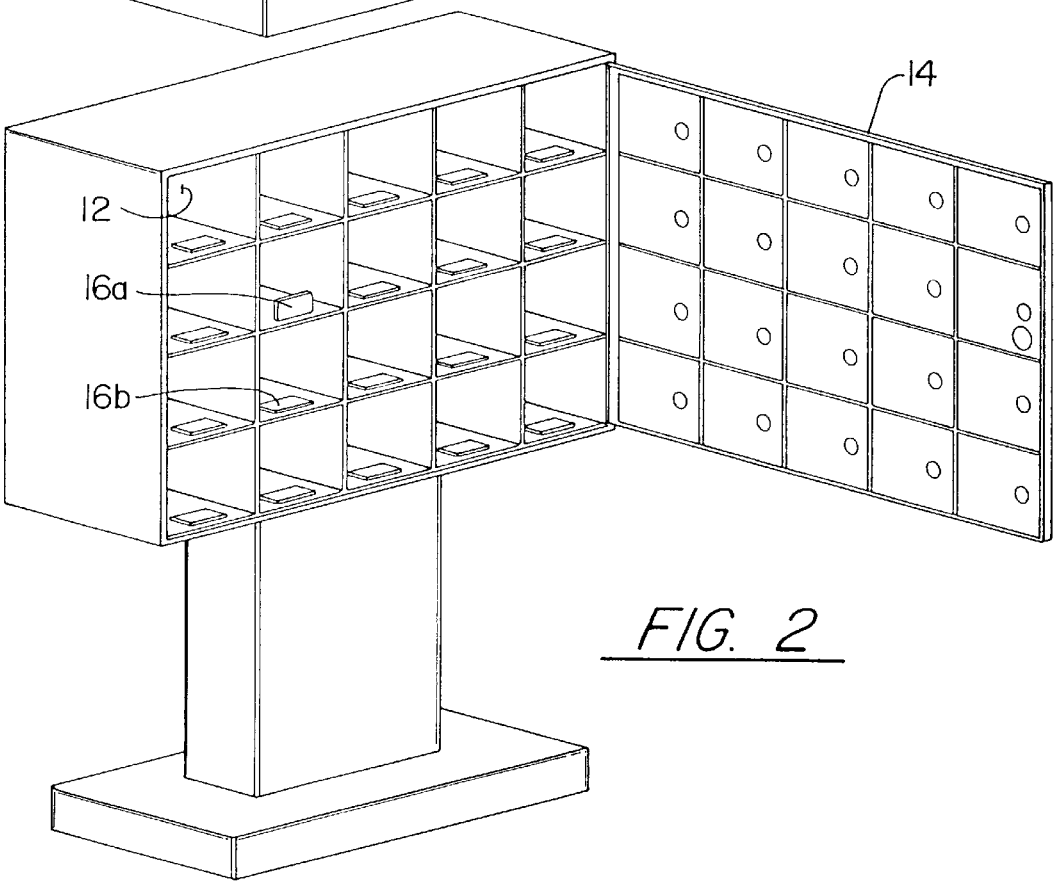
FIG. 2 is a front perspective view of the cluster mailbox with the front access panel opened showing a plurality of devices of the present invention inside of each box.
Figure 3:
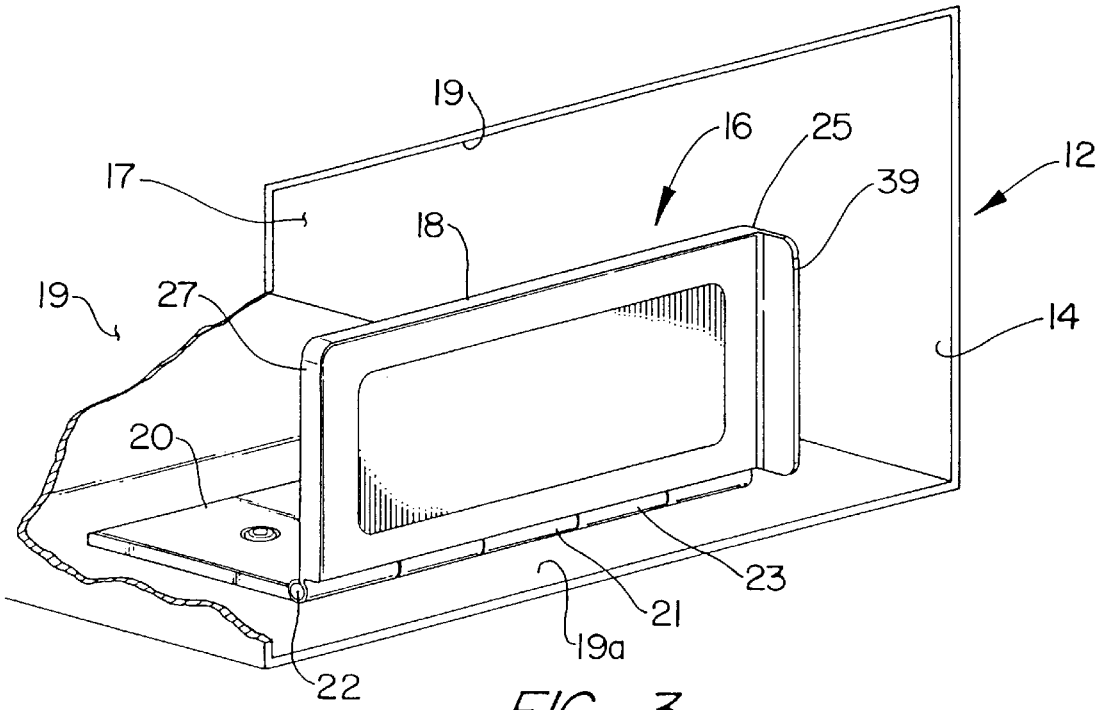
FIG. 3 is a partial perspective view of a mailbox device of the present invention shown inside of an individual box.
Figure 4:
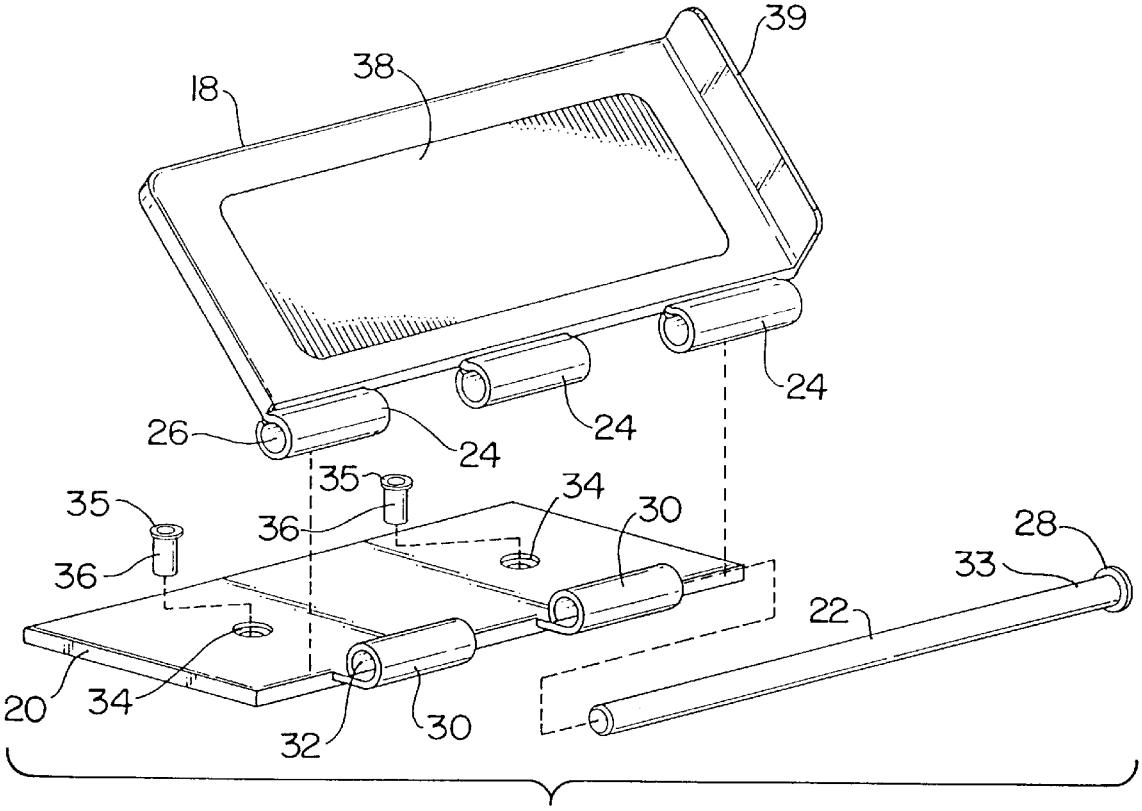
FIG. 4 is an exploded perspective view of the device of the present invention.

As shown in FIG. 2, the front panel 14 opens so that the mail carrier has access to the individual mailboxes 12. According to the present invention, a mailbox communication device 16 is located inside of each mailbox 12. The device 16*a* is activated to notify the mail carrier that the box contains outgoing mail or delivery instructions. The device 16*b* is otherwise approximately folded flush with the box 12.

Each box 12 has a rectangular cavity 17 for accepting mail, the cavity 17 is defined by four walls 19. The device 16 has a rotatable portion 18 pivotly connected to a fixed portion 20. The rotatable portion 18 has a first edge 21, likewise, the fixed portion 20 has a first edge 23.

Extending from the rotatable portion 18 at the first edge 21 is a plurality of knuckles 24. The knuckles 24 are axially aligned so as to have a rotatable portion passageway 26.

Extending from the fixed portion 20 at the first edge 23 is at least one knuckle 30. The knuckles 30 are axially aligned to have a fixed portion passageway 32. The passageways 26 and 32 are axially aligned and the portions 18 and 20 are pivotally connected with a rod 22. The rod 22 has a externally extending tapered shoulder 33 adjacent to a head 28. The rod 22 has a slight interference fit into the passageways 26 and 32 so that a minimum amount of force is required to pivot the rotatable portion 18 in relation to the fixed portion 20 and so that the rotatable portion 18 will stay at a certain position until a new force is applied to the rotatable portion 18. The tapered shoulder 33 provides a positive lock of the rod 22 and the passageway 26. The head 28 acts as a stop and as an assembly aid.

The fixed portion 20 has a pair of countersunk holes 34 so that the fixed portion may be secured in the cavity 17 to one of the walls 19. Preferably, the fixed portion 20 is secured to a bottom wall 19*a* adjacent to the front panel 14. A pair of rivets 36 located in the countersunk holes 34 fasten the fixed portion 20 to the bottom wall 19*a*. The rivets 36 each have a head 35 adapted to fit into the countersunk hole 34. The rivets 36 also each have a deformable head 37, which is deformed after placement of the rivet 36 through the wall 19*a*.

The rotatable portion 18 has an internal surface 48 and an external surface 50. Likewise, the fixed portion 20 has an internal surface 42 and an external surface 44. The rotatable portion 18 has a flange 39 extending perpendicular from the external surface 50 at a lateral side 25.

Figure 5:
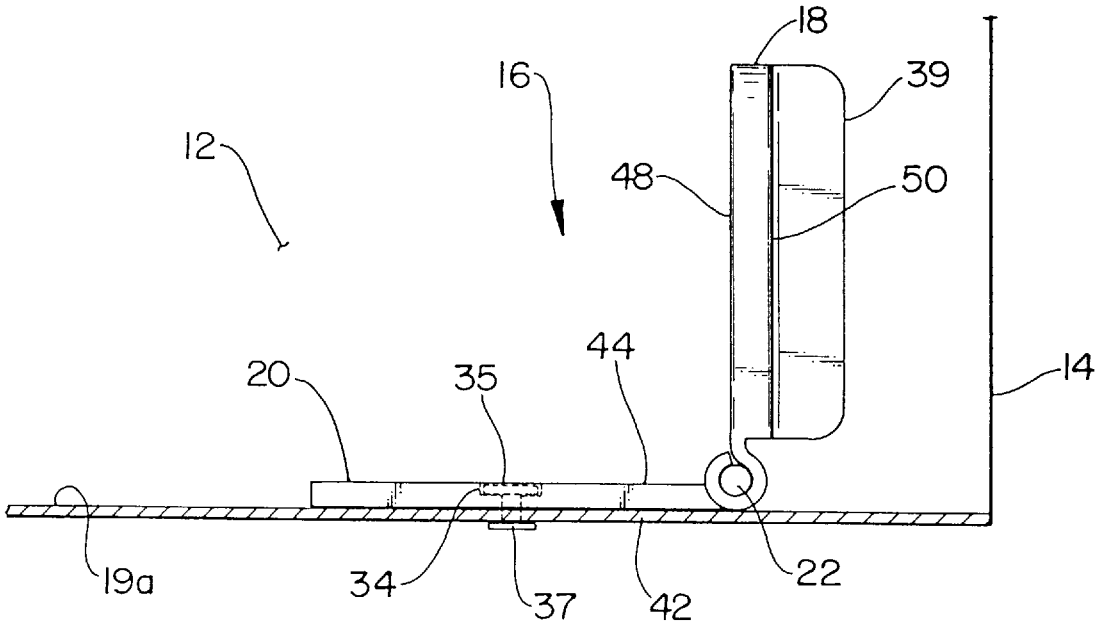
FIG. 5 is a side elevational view of the device of the present invention shown with a rotatable portion rotated from a fixed portion.
Figure 6:
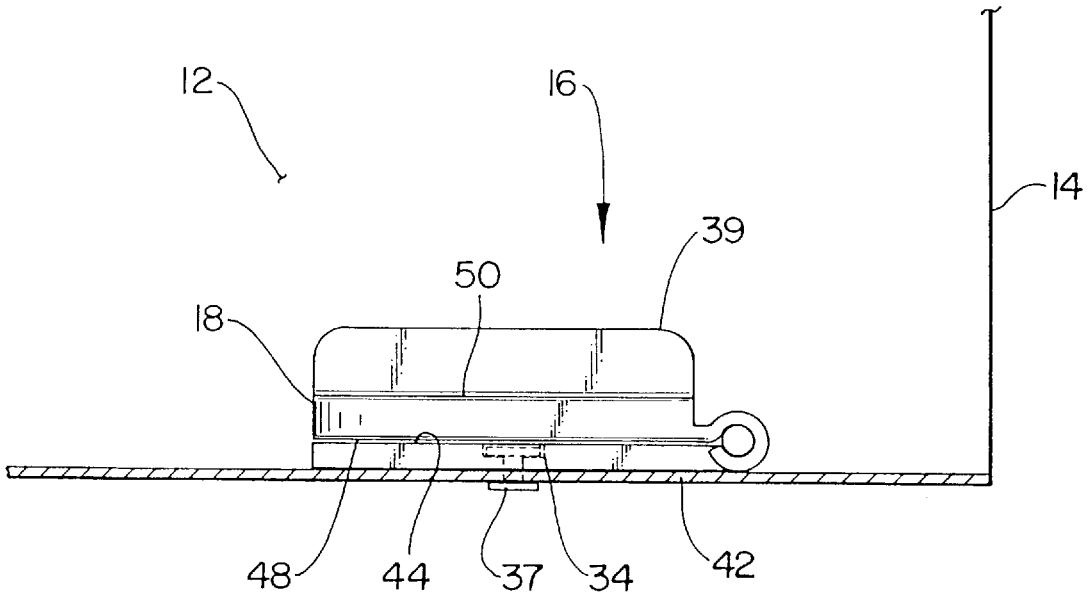
FIG. 6 is a side elevational view of the device of present invention shown with the rotatable portion adjacent to the fixed portion.

The device 16 is shown activated in FIG. 5, the rotatable portion 18 is shown pivoted approximately 90 degrees from the fixed portion 20 and the box bottom wall 19*a*. The device 16 is shown at rest in FIG. 6, with the rotatable portion 18 being pivoted so that the rotatable portion 18 and the fixed portion 20 are approximately parallel with each other. When the device 16 is at rest, the rotatable internal surface 48 is adjacent to the fixed portion external surface 44.

Typically, the device of the present invention is at rest. The mailbox user will activate the device 16 when the user has a piece of outgoing mail for pickup or has mail delivery instructions. The user would open the individual mailbox door and then place the outgoing mail or the delivery instructions in the box. The device 16 is then activated by the user pulling up and pivoting the rotatable portion 18 so that the rotatable portion 18 is approximately 90 degrees from the fixed portion 20 and the bottom wall 19*a*, therefore, the cavity 17 and the line of sight into the box is blocked by the rotatable portion 18. The user may use the flange 39 to apply force to the rotatable portion 18.

To further the visual effectiveness of the rotatable portion 18, a decal 38 may be attached to the rotatable portion external surface 50. The decal 38 may have a bright color for quick visual identification and may have the unit number for the mailbox.

After the mail carrier sees that the particular mailbox has outgoing mail or a message, the carrier will push or pivot the rotatable portion 18 to the resting position and retrieve the mail or message.

The device 16 has a low profile so that when the device 16 is at rest, the mailbox and the cavity 17 are essentially unobstructed. Therefore, the addition of the device 16 to a cluster mailbox adds the benefits of increased communication between the user and the mail carrier, increasing user satisfaction while improving the mail carrier's efficiency.

Figure 7:
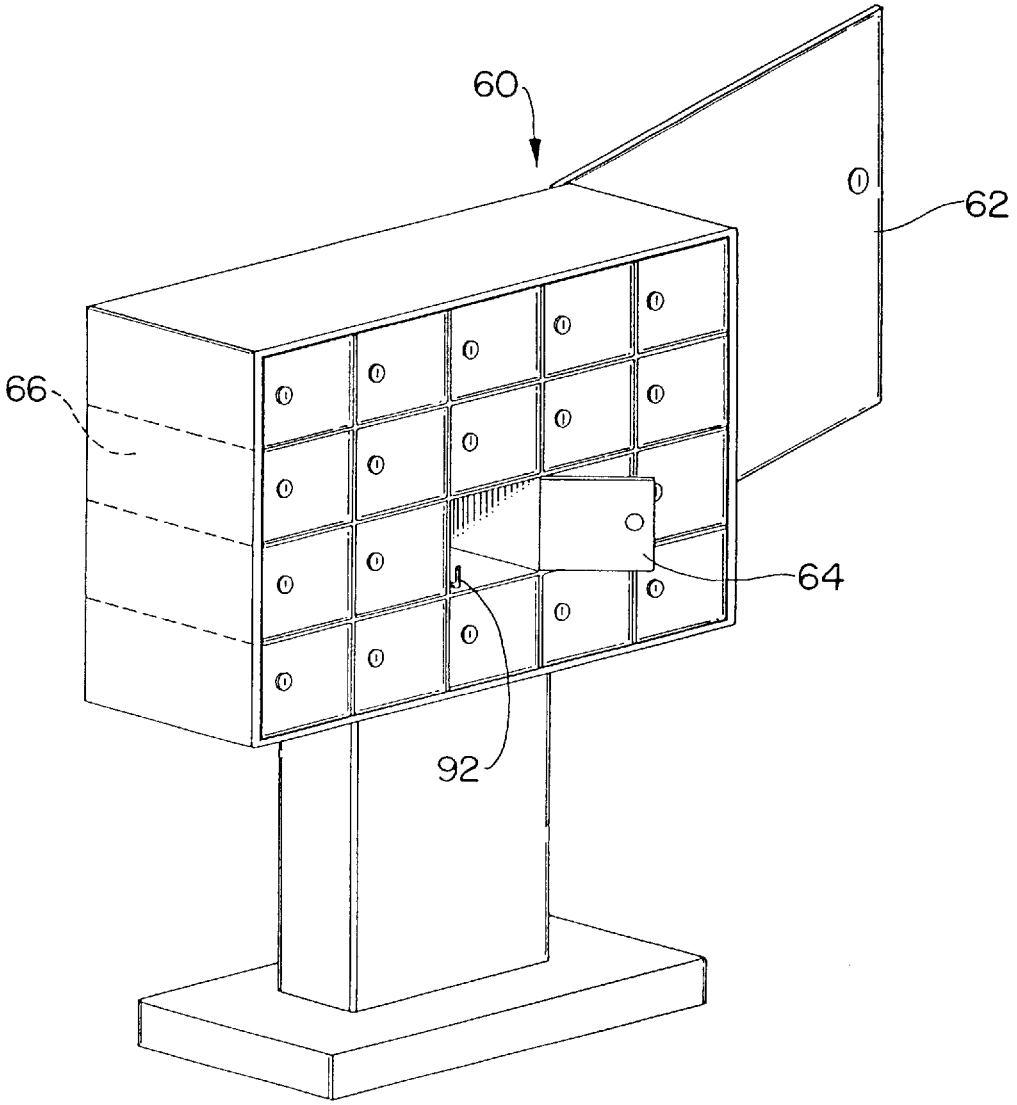
FIG. 7 is a front perspective view of a cluster mailbox with a front user access panel and a rear mail carrier access panel.

A separate embodiment is similar to the above described embodiment, except that the second embodiment is designed for use with dual access cluster boxes as shown in FIG. 7. Some cluster mailboxes 60 are of the design that have front access for the individual mailboxes, and rear access for the mail carrier. The cluster box 60 has a rear multiple access panel 62 and a plurality of front access, individual mailbox doors 64.

Figure 8:
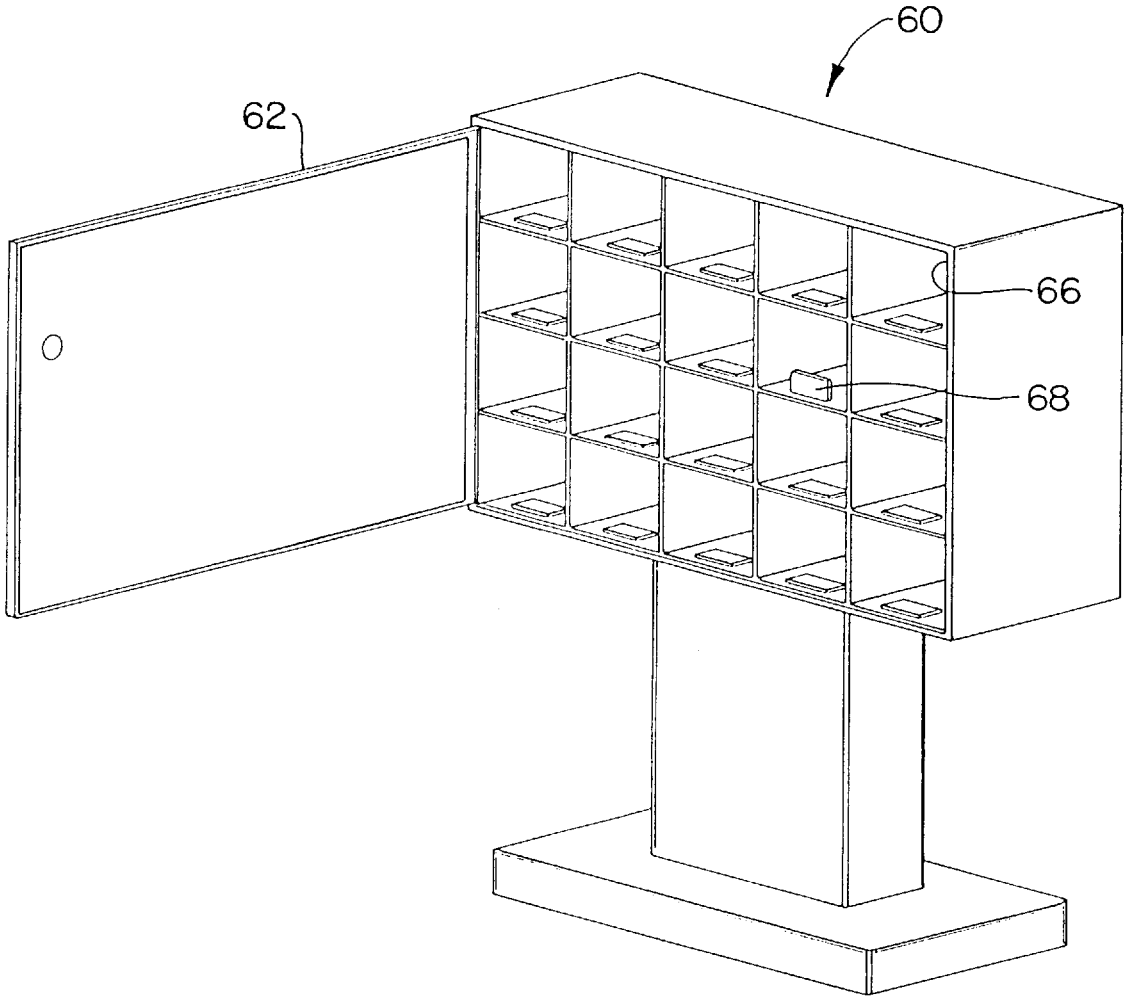
FIG. 8 is a rear perspective view of the cluster mailbox with the rear access panel opened showing a plurality of devices and a second embodiment of the present invention inside of each box.
Figure 9:
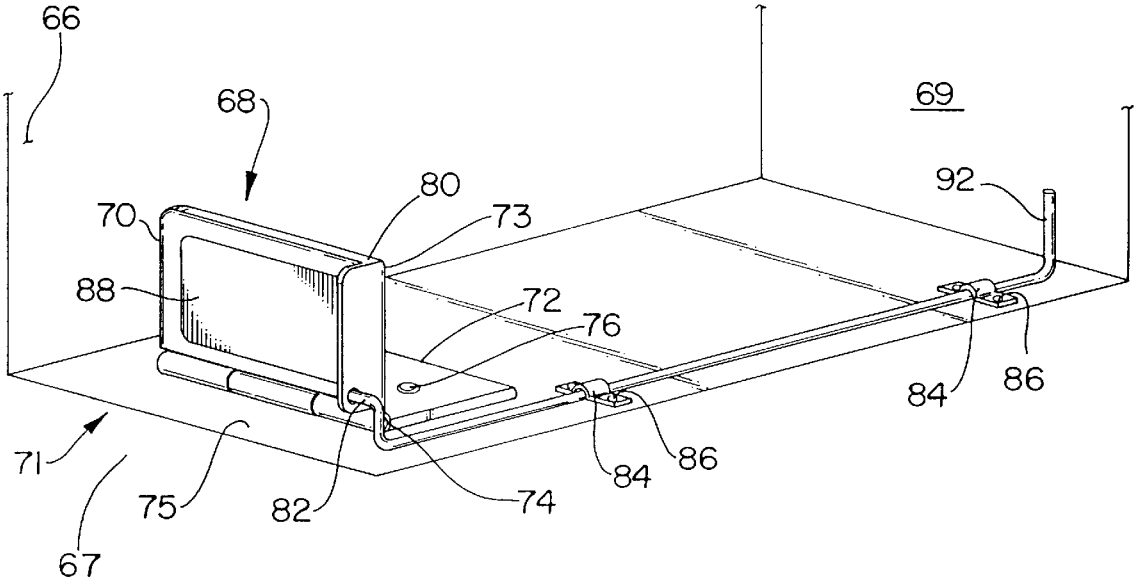
FIG. 9 is a partial perspective view of a second embodiment of a device of the present invention shown inside of an individual box with a rotatable portion rotated from a fixed portion.
Figure 10:
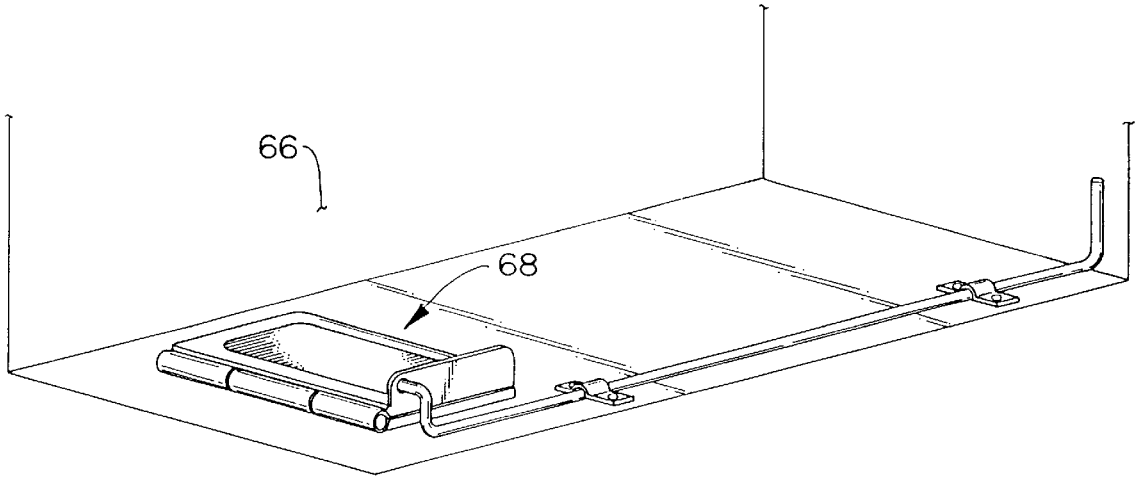
FIG. 10 is a partial perspective view of the device of the present invention with the rotatable portion shown adjacent to the fixed portion.

As shown in FIGS. 8 and 9, when the mail carrier opens the rear access panel 62, each mailbox 66 has passageway 67 and a device 68, which is visible when the carrier opens the rear access panel 62. Each passageway 67 has a front, or user end 69 and an opposite rear, or carrier end 71.

As shown in FIGS. 9, 10, 11, and 12, the device 68 has a rotatable portion 70 and a fixed portion 72. The rotatable portion 70 has a plurality of knuckles 100 and the fixed portion 72 has at least one knuckle 102. A rod 74 pivotly connects the rotatable portion 70 to the fixed portion 72 through the knuckles 100 and 102. The fixed portion 72 is secured to a bottom wall 75 by use of rivets 76 through the fixed portion 72. The rivets 76 are placed through countersunk holes in the fixed portion 72.

The rotatable portion 70 is activated remotely by a lever 78 that extends the longitudinal length of the mailbox passageway 67. The lever 78 has a handle 92 at the user end 69, which is adjacent to the front access door 64. The lever 78 is pivotly connected to the rotatable portion 70 at the carrier end 71, which is adjacent to the rear access door 62. The lever 78 is secured with a loose fit to the bottom wall 75 by at least two brackets 84 that are aligned longitudinally. The brackets 84 are riveted to the bottom wall 75 with bracket rivets 86. The brackets 84 secure the lever 78 to the bottom wall 75 while allowing for freedom of longitudinal movement of the lever 78 so that the device 68 may be activated.

Figure 13:
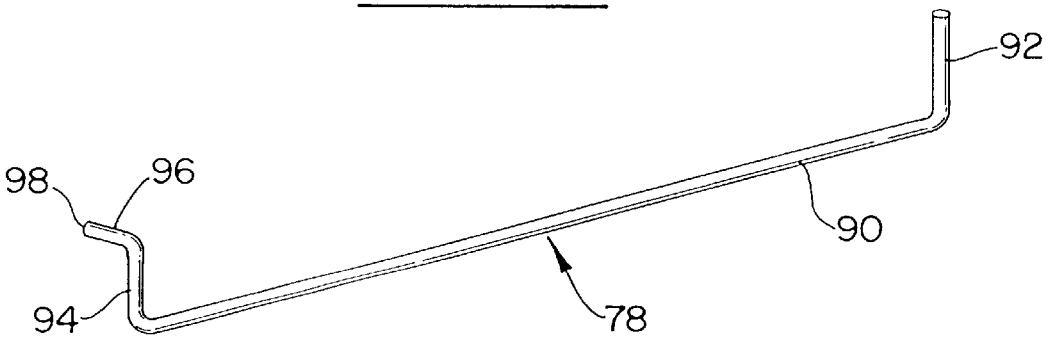
FIG. 13 is a perspective view of a device lever of the present invention.

As shown in FIG. 13, the lever 78 has a longitudinal mid-portion 90 with the handle 92 extending perpendicular to the mid-portion 90. At the opposite end of the lever 78, a second portion 94 extends perpendicular to the mid-portion 90 so that the second portion 94 and the handle 92 are parallel with each other. A third portion 96 extends perpendicularly from the second portion 94 so that the third portion 96 is perpendicular to the midsection 90. The third portion 96 has a third portion end 98 as a termination point. The lever 78 is made from 16 gauge wire so as to allow for a certain amount of flexure as the device is activated.

Figure 11:
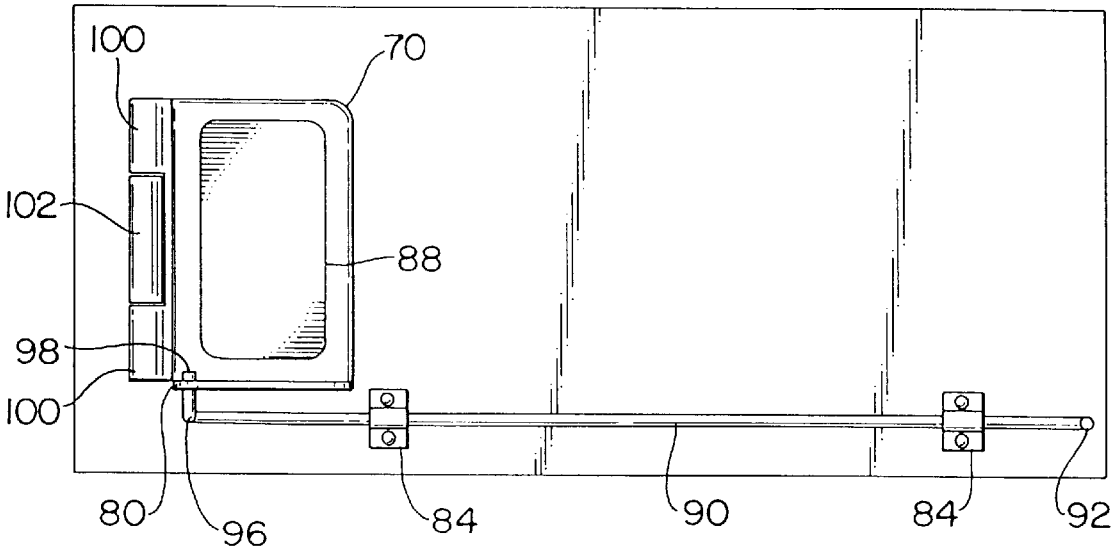
FIG. 11 is a top plan view of the device of the present invention with the rotatable portion shown adjacent to the fixed portion.
Figure 12:
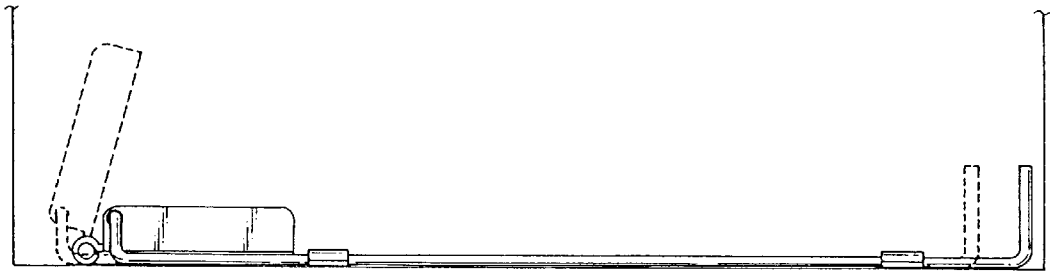
FIG. 12 is a side elevational view of the device of present invention shown with the rotatable portion adjacent to the fixed portion.

The rotatable portion 70 has a flange 80 extending from a lateral side 73. The lateral side 73 has an opening 82. As shown in FIG. 11, the third portion end 98 extends beyond the opening 82 so that the lever 78 and the rotatable portion 70 are pivotally connected. The device then may be activated by the user by pushing the lever 78 by the handle 92, which raises the rotatable portion 70. A decal 88 is located on the external surface of the rotatable portion 70 for quick visual identification. The mail carrier opens the rear access panel to deliver the mail and takes notice if any of the boxes have devices 68 that are activated. If so, the carrier pushes the rotatable portion 70 down with his finger, which in turn, pushes the lever 78 back toward the front access door 64. Then the carrier retrieves the outgoing mail or delivery instruction.

The device of the first embodiment may be easily retrofitted into the device of the second embodiment.; the lever 78, brackets 84, and the opening 82 are the only additional elements disclosed in the second embodiment. In addition, any existing cluster mailbox may be easily retrofitted to incorporate the present invention. The fixed and rotatable portions are preferably made of fabricated sheet metal with smooth, rounded corners.

The device of the second embodiment provides the same user satisfaction and increase in mail carrier efficiency as the previously described embodiment, however, the second embodiment incorporates the device in the dual access cluster box. As with the first embodiment, the device 68 has a low profile so that when the device is at rest, the mailbox and the passageway are essentially unobstructed. Therefore, the addition of the device 68 to a dual access cluster mailbox adds the benefits of increased communication between the user and the mail carrier, increasing user satisfaction while improving the mail carrier's efficiency.

Although this invention has been shown and described with respect to a detailed embodiment, those skilled in the art will understand that various changes in form and detail may be made without departing from the spirit and scope of the claimed invention.

I claim:

1. A cluster box device, wherein a cluster box comprises a plurality of mailboxes arranged in a matrix configuration, each said mailbox having a mailbox passageway for accepting mail, said mailbox passageway being defined by walls, said mailbox passageway having a user end and a carrier end, a plurality of first doors corresponding to each of said user end mailbox passageways and a rear access panel allowing access to said carrier end of said mailbox passageways, the device comprising:

a fixed portion and a rotatable portion, the portions each having at least one knuckle, each knuckle having a knuckle passageway, the knuckle passageways being axially aligned;

the rotatable portion having an eternal surface and a lateral side with a flange extending from the external surface;

a rod being housed in said knuckle passageways so that the portions are pivotally connected together, the fixed portion having a pair of countersunk openings housing a corresponding pair of fasteners so that the fixed portion is secured to one of the mailbox walls at said carrier end of one of said mailboxes;

a lever extending the length of the mailbox passageway, the lever having a handle at the user end and an extension at the carrier end;

at least two brackets fastened to one of the mailbox walls, each bracket loosely housing the lever;

the extension being pivotally connected to the flange of said rotatable portion so that a force applied to the lever raises or lowers the rotatable portion.

2. The cluster box device of claim 1, wherein the rotatable portion flange has an opening and wherein the lever extends through said opening so that the lever and the rotatable portion are pivotally connected.

3. The cluster box device of claim 1 wherein the rod has a head and an externally extending shoulder adjacent to said head, said rod having an interference fit into the knuckle passageways.

4. The cluster box device of claim 1, wherein the rotatable portion has an external surface with a decal attached to said external surface.

5. A cluster box device, wherein a cluster box comprises a plurality of mailboxes arranged in a matrix configuration, each said mailbox having a mailbox passageway for accepting mail, said mailbox passageway being defined by walls, said mailbox passageway having a user end and a carrier end, the plurality of first doors corresponding to each of said user and mailbox passageways in a rear access panel allowing access to said carrier end of said mailbox passageways, the device comprising:

a fixed portion and a rotatable portion, the portions being pivotly connected to each other;

the rotatable portion having an external surface and a flange extending from the external surface at the lateral side;

the fixed portion being fixedly attached to one of said mailbox walls adjacent to said access panel;

the lever extending the length of the mailbox passageway the lever having a handle at the user end and an extension at the carrier end;

a means for housing the lever in said mailbox passageway;

the extension being pivotly connected to the flange of the said rotatable portion so that a force applied to the lever raises or lowers the rotatable portion.

6. The cluster box device of claim 5, further comprising the portions each have at least one knuckle with a passageway, the knuckle passageways being aligned;

a rod being housed in said aligned passageways so that the portions are pivotly connected together.

7. The cluster box device of claim 5, wherein the rotatable portion flange has an opening and wherein the lever extends through said opening so that the lever and the rotatable portion are pivotly connected.

* * * * *

UNITED STATES PATENT AND TRADEMARK OFFICE
CERTIFICATE OF CORRECTION

PATENT NO. : 5,820,019

DATED : October 13, 1998

INVENTOR : Peter M. Spitale

It is certified that error appears in the above-identified patent and that said Letters Patent is hereby corrected as shown below:

Title page at [73] Assignee: change "Innovative Creations, Incorporation" to --PSI Enterprises, Inc.--.

Signed and Sealed this

Twenty-fourth Day of August, 1999

*Attest:*

Q. TODD DICKINSON

*Attesting Officer*

*Acting Commissioner of Patents and Trademarks*